United States Patent [19]

Sjölander

[11] 4,134,244

[45] Jan. 16, 1979

[54] CLADDING

[75] Inventor: Carl J. O. Sjölander, Koping, Sweden

[73] Assignee: A-Betong Aktiebolag, Vaxjo, Sweden

[21] Appl. No.: 829,370

[22] Filed: Aug. 31, 1977

[30] Foreign Application Priority Data

Sep. 20, 1976 [SE] Sweden ..... 7610381

[51] Int. Cl.[2] ..... E04D 1/50

[52] U.S. Cl. ..... 52/763; 52/478; 52/536; 52/542; 52/550

[58] Field of Search ..... 52/519, 522, 528, 536, 52/542, 588, 492, 478, 550, 483, 529, 537, 664, 669, 534, 545, 551, 547

[56] References Cited

U.S. PATENT DOCUMENTS

| | | | |
|---|---|---|---|
| 3,131,513 | 5/1964 | Grigas et al. | 52/551 X |
| 3,236,932 | 2/1966 | Grigas et al. | 52/551 X |
| 3,242,626 | 3/1966 | Blok | 52/478 |
| 3,347,009 | 10/1967 | Meddick | 52/551 X |
| 3,412,516 | 11/1968 | Lindström | 52/492 |
| 3,548,556 | 12/1970 | Vermeulen | 52/492 |

FOREIGN PATENT DOCUMENTS

| | | | |
|---|---|---|---|
| 1569562 | 6/1969 | France | 52/551 |

*Primary Examiner*—Price C. Faw, Jr.
*Assistant Examiner*—Carl D. Friedman
*Attorney, Agent, or Firm*—Fred Philpitt

[57] ABSTRACT

A cladding for the exterior walls or the roof of a building comprises a plurality of overlapping, profiled and elongate panels of e.g. sheet metal or plastic attached to supporting rails extending in spaced relationship over the surface to be covered in a direction intersecting the longitudinal directions of the panels. Each supporting rail has a series of rigid fastener means each with a dovetail-shaped incut. One longitudinal marginal portion of each panel has a resiliently deformable cross section adapted for snapping into the incut of one fastener means on each of at least two adjacent supporting rails and forms a groove with undercut side walls opening towards the front or outer side of the cladding. The opposite longitudinal marginal portion of each panel also has a resiliently deformable cross section adapted to partly enter said groove of an adjacent panel and to be retained therein in a clamped position in which at least one of the two interengaging marginal panel portions is slightly deformed.

5 Claims, 7 Drawing Figures

CLADDING

BACKGROUND OF INVENTION

This invention relates to a cladding, or in other words a clothing, of an exterior wall and/or the roof of a building, which comprises a plurality of elongate covering elements each having a greater length than width and each forming a profiled panel, the thickness of which is considerably smaller than said other dimensions thereof and preferably uniform throughout. These covering elements or panels may be made of metal, plastic or any other suitable material. For instance, they may be manufactured by profiling a thin but rather stiff sheet material, such as sheet metal or sheet plastic, or they may be produced by an extrusion process from extrudable metals or plastic.

More specifically the invention relates to a cladding of the kind referred to, in which adjacent panels overlap in the direction of their widths and have their longitudinal marginal portions interengaged in a hook-like manner along substantially their entire lengths, one of said longitudinal marginal portions of each panel forming a channel opening towards the front or outer side of the cladding, and the opposite longitudinal marginal portion thereof forming a channel opening towards the rear or inner side of the cladding, and in which the panels are supported by a plurality of spaced supporting rails extending over the surface to be covered in a direction intersecting the longitudinal directions of the panels themselves, said rails being at intervals, corresponding to the exposed widths of the panels, provided with series of fastener means for the attachment of the panels and for engagement with one longitudinal marginal portion of a related one of them.

It is to be understood that the hook-like interengagement of the longitudinal marginal portions of adjacent panels is an important factor in the provision of an exterior cladding for a building wall or roof which has for its main purpose to protect the structures behind or beneath it from rain, snow and heavy winds. Without such hook-like interengagement, the wind may too easily force itself or water through the joints between the panels.

THE PRIOR ART

In a known cladding of the kind referred to hereinbefore, disclosed in the U.S. Pat. No. 3,131,513 to D. P. Grigas et al. the fastener means of the supporting rails are formed by punching out more or less resiliently deformable tongues from the sheet metal material of the rails themselves, which, however, requires that the supporting rails must be made of a rather thin sheet metal, whereby they will be structurally weak, easily damaged in handling and of interferior durability. The punching out of the tongues further weakens the rails. On the other hand, the so called clips formed by the tongues will, even if they were made separately and attached to the rails, be rather weak and easily misformed or broken and, hence, make the attachment of the panels less reliable. In addition, the panels of the known cladding are shaped and arranged in such a way that they can move relative to each other in a direction normal to the main plane of the cladding between the supporting rails, whereby they will show a tendency to rattle under the influence of the wind, if the spacing between adjacent rails is not kept rather small.

BRIEF SUMMARY OF INVENTION

This invention has for its object to provide an improved cladding of the kind defined, in which the panels may be rapidly and simply snapped fast to the supporting rails without the need of making the fastener means of said rails resilient or otherwise deformable, the attachment of the panels thereby obtained being very reliable and based on a resiliency of the longitudinal marginal portions of the panels themselves. As a result, the supporting rails including their fastener means may be made sturdier than before, which will facilitate their handling as well as their mounting on the building structure to be covered by the cladding. In its preferred embodiment the invention also, as a consequence of the design of the longitudinal marginal portions of the panels that is needed for the proper attachment of the panels to the rigid supporting rails, provides for a resilient locking and sealing interengagement between adjacent panels which will effectively prevent them from rattling and instead assure such a stiffening interaction between them that the spacings between adjacent supporting rails without any inconvenience may be considerably increased as compared with the spacings needed in the prior art referred to hereinbefore.

According to the invention these advantages are basically achieved by forming each fastener means of each supporting rail from a longitudinally extending flange-like member or part thereof, in which an incut having a constricted opening is provided, and by providing the one longitudinal marginal portion of each panel that forms a channel opening towards the front or outer side of the cladding with a resiliently deformable cross section capable of being snapped into said incut of the related fastener means and with side wall members, which converge towards the channel opening to define between them a groove capable of receiving and retaining the opposite longitudinal marginal portion of an adjacent panel.

In the preferred embodiment of the invention the opposite longitudinal marginal portion of each panel, which forms a channel opening towards the rear or inner side of the cladding and which is adapted to be at least partly received in the groove between the converging side wall members of the firstmentioned longitudinal marginal portion of an adjacent panel, also has a resiliently deformable cross section, the configuration of which is selected in such a manner that said opposite longitudinal marginal portion will be retained in said groove in a clamped position, in which at least one of the two interengaging marginal panel portions is slightly deformed and thus under tension, whereby a firm connection and a perfect seal between adjacent panels will be stablished throughout their lengths, when the panels are properly mounted on the supporting rails.

BRIEF DESCRIPTION OF THE DRAWINGS

For further elucidation of the invention some embodiments thereof will now be described with reference to the accompanying drawings. In the drawings

DETAILED DESCRIPTION OF PREFERRED EMBODIMENTS

Figure 1:
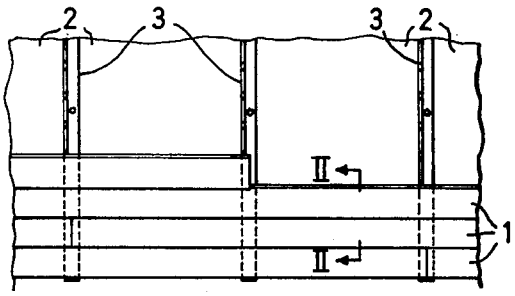
FIG. 1 is a fragmentary front elevation of a building facade that is being covered with a first form of cladding embodying the invention.
Figure 2:
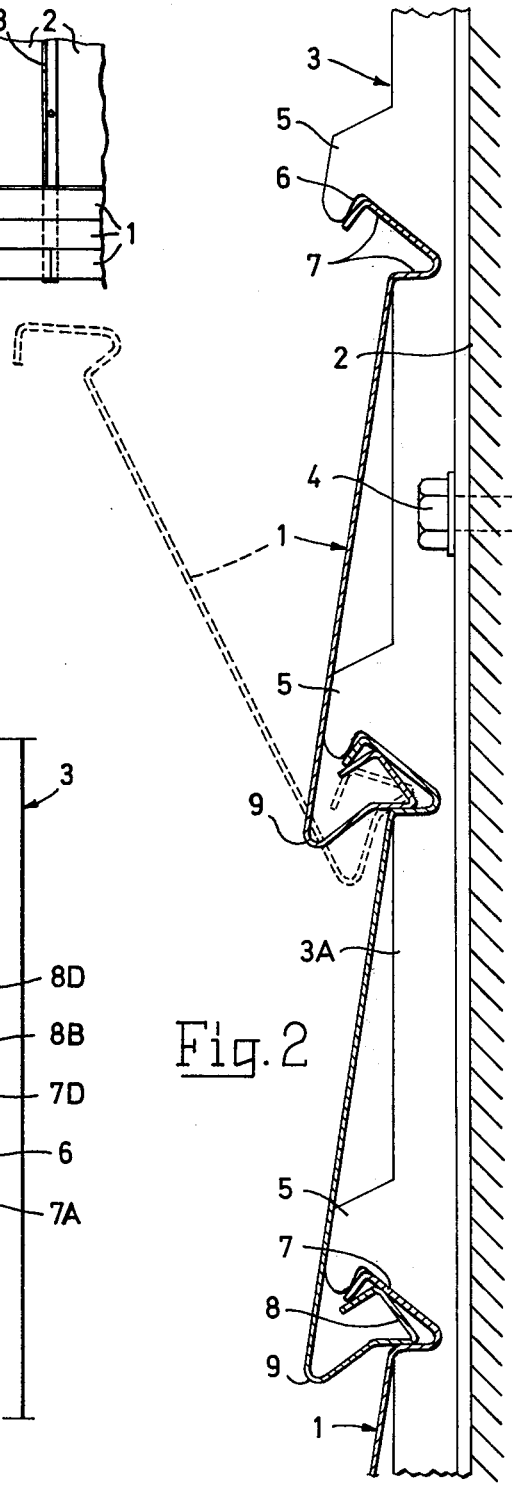
FIG. 2 is an enlarged section taken along the line II—II in FIG. 1.
Figure 3:
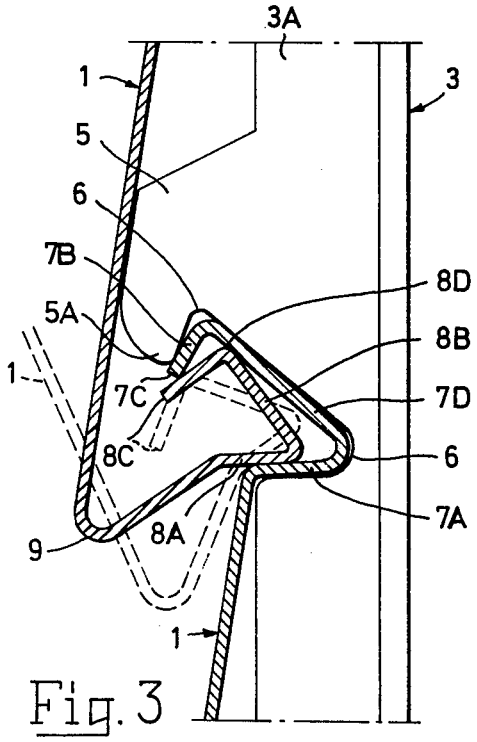
FIG. 3 is a still more enlarged part of FIG. 2.

The facade or exterior wall cladding illustrated in FIGS. 1 to 3 inclusive comprises in the first place a plurality of elongate covering elements or panels 1 of profiled sheet metal which extend horizontally over the surface 2 of the building to be covered by the cladding. The panels 1 overlap each other in a vertical direction and have a flat but slightly inclined front face, whereby the finished cladding will simulate a clapboard type of weather-boarding. However, it is to be understood that the faces of the panels may instead be convex to give the impression of a log-cabin or otherwise shaped to meet various aesthetic desires. Also, each panel may be designed to simulate two or more boards or logs, one above the other. In practice, it is preferred to use panels having a width of four inches or more.

The panels 1 are supported on the building surface 2 behind them by means of horizontally spaced, vertically extending supporting rails 3 which are shown as bars of L- or T-shaped cross section but which may in certain cases also be of U-shaped cross section. Preferably the rails 3 are made of galvanized iron or some other strong and durable material so that they will exhibit considerable stiffness, whereby they will be capable of bridging possible openings or cavities in the building structure behind, wherever needed, and may also be incorporated in said structure as load-supporting studs or the like, if desirable. The supporting rails may be secured to the building structure by means of screws, as indicated at 4, or in any other suitable way, and they have to direct at least one flange-like portion 3A outwards from the surface 2 and towards the panels 1. In practice the spacing between the supporting rails most frequently is at least twenty inches or more, but each panel 1 always has to be supported by two or more rails, which may necessitate a reduced spacing in certain places.

As clearly appears from FIGS. 2 and 3, the outwardly directed flange-like portion 3A of each supporting rail 3 is contoured, such as by a punching or cutting operation, to form a series of hook-like fastener means 5 for the attachment of the panels 1, each such fastener means being thus formed from a longitudinally extending, flat and rigid flange-like projection on the rail, which projection may be integral with the rail or secured thereto, such as by welding. The fastener means 5 are provided along the length of each rail at vertical intervals corresponding to the exposed or nominal widths of the panels, and it is to be noted that the fastener means are neither resilient nor in any other way easily deformable but represent rigid members of the stiff and robust supporting rails 3. As can be seen, the fastener means 5 also form interior supports for the panels 1 and each of them comprises a free, downwardly directed hook member 5A.

Inside its hook member 5A each hook-like fastener means 5 has an incut 6 with a constricted opening formed therein. In the example shown, this incut 6 has a dovetail-like configuration and a bottom line or edge extending approximately at an angle of 50° to the longitudinal direction of the supporting rail 3. In practice, this angle may vary between about 40° and about 60°. The inner one of the two converging side lines or edges of the incut forms a substantially right angle to the longitudinal direction of the supporting rail, and the other one, representing the inner edge of the hook member 5A, forms an acute angle to the longitudinal direction of the rail, whereby the angle between the converging sides of the incut will also be an acute one. The hook member 5A is relatively short so as to extend inwardly or downwardly over only a part of the incut 6 leaving the rest of it open towards the cladding formed by the panels 1.

The incut 6 of each fastener means 5 is adapted to receive an upper longitudinal marginal portion 7 (FIG. 2) of a related panel 1, which portion extends along substantially the whole length of the panel and has a resiliently deformable cross section, the outer contour of which fairly well fits the incut 6 and is thus also generally dovetail-like. As shown in FIG. 3 this upper marginal portion of each panel 1 is defined by an inner side wall member 7A extending at a substantially right angle to the main plane of the panel, an outer side wall member 7B extending inwardly towards the longitudinal center line of the panel in a plane forming an acute angle to the main plane thereof and having a sufficient length to let its free edge 7C project beyond and below the tip of the hook member 5A, and a bottom wall member 7D connecting said side wall members and extending at an obtuse angle to the main plane of the panel.

More specifically the cross sectional configuration of the upper marginal portion 7 of the panel is selected in such a manner that said portion under resilient deformation may be forcibly snapped into the incut 6 and then be able to approximately regain its original, undeformed cross sectional shape therein in order to thereby become lockingly and reliably but removably retained in the incut inside the hook member 5A. Thus, when properly received in the incut, the upper marginal portion 7 of the panel 1 should be under only moderate tension which must be great enough to prevent unintentional horizontal movement of the panel relative to the supporting rail 3 but small enough to permit longitudinal expansion and contraction of the panel.

As can be seen, the wall members 7A, 7B and 7D of the upper longitudinal marginal portion 7 of each panel 1 form between them a groove or channel having undercut side walls and opening towards the front or outer side of the cladding. This groove is used to receive and retain the opposite or lower longitudinal marginal portion of the next adjacent panel or, more specifically, an attachment portion 8(FIG. 2) thereof, which also extends along substantially the whole length of the panel behind a downwardly directed nose portion 9 thereof and which forms a channel that opens towards the rear or inner side of the cladding. Also this attachment portion 8 has a resiliently deformable cross section that approximately resembles an incomplete, substantially right-angled triangle and comprises a first wall member 8A extending approximately at a right angle to the main plane of the panel, a second wall member 8B forming originally an angle of about 50° to said first wall member, and a third wall member 8C forming approximately a right angle to said second wall member and having a free edge.

Now, the size and cross sectional configuration of the attachment portion 8 are so selected and adapted to the inner contour of the groove of the upper longitudinal marginal portion 7 of the next adjacent panel that it can be inserted therein with its first wall member 8A taking support against the side wall member 7A and the knee 8D between its second and third wall members entering inside the free edge 7C, as illustrated in dotted lines in FIG. 3. Thereafter the attachment portion 8 is slightly turned to occupy under a small tension and deformation a final position, illustrated in full lines, in which either said knee 8D is resiliently pressed against the bottom wall member 7D, or the third wall member 8C resiliently abuts the free edge 7C. In either case a double seal with a capillarity-breaking space therebetween will be achieved, namely when the panel having its lower attachment portion 8 inserted in the groove of the upper marginal portion of the next underlying panel is swung up as indicated in FIG. 2 to have its own upper marginal portion 7 snapped fast to the supporting rail 3.

The attachment portion 8 forming part of the lower longitudinal marginal portion of each panel 1 will thus be retained in a clamped position, in which at least one of the two interengaging marginal panel portions is slightly deformed and thus under tension, when the panels are properly mounted, and the interconnection between the panels will not only be established along substantially the whole panel length but also be firm enough to make adjacent panels brace each other and to prevent the panels from rattling even in a heavy wind. In addition, the attachment portion 8 will serve as a safety lock for the connection between the upper marginal portion 7 of the next underlying panel and its fastener means 5 on the supporting rails 3 by preventing said portion 7 from sagging.

Figure 4:
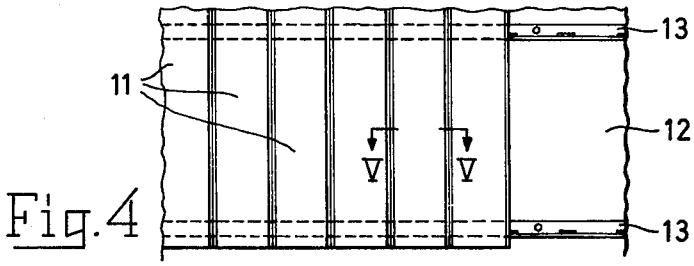
FIG. 4 is a fragmentary front elevation of a building facade that is being covered with a second form of cladding embodying the invention.
Figure 5:
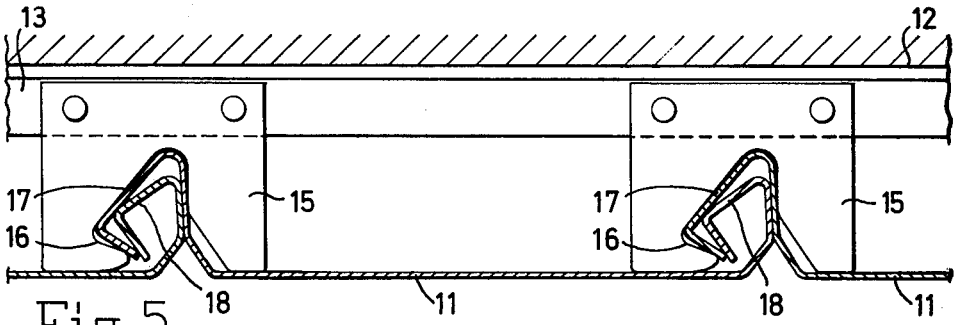
FIG. 5 is an enlarged section taken along the line V—V in FIG. 4.

The variant of the cladding embodying the invention which is illustrated in FIGS. 4 and 5 differs from the one just described only in details and by the fact that the elongate panels 11 extend in a vertical direction over the building wall surface 12 to be covered, whereas instead the supporting rails 13 extend in a horizontal direction in vertically spaced relationship. As can be seen from FIG. 5, each fastener means 15 is in this case formed from a separate plate secured to the supporting rail 13 by rivets, but still it has a substantially dovetail-like incut 16 for receiving a first longitudinal marginal portion 17 of a related panel, which may be snapped fast therein in the same manner as described in connection with FIG. 3. Then the opposite longitudinal marginal or attachment portion 18 of the next adjacent panel may be retained and clamped in the channel or groove formed by the portion 17, also in the same manner as previously described. A difference to be mentioned is that the panels 11 have their main faces lying in a common plane that is parallel to the building wall surface 12 and have bevelled sides, whereby the joints between them will be marked by rather deep, V-shaped grooves. Also, the fastener means 15 are formed to support both the two hooked-together panels in the vicinity of each joint.

Figure 6:
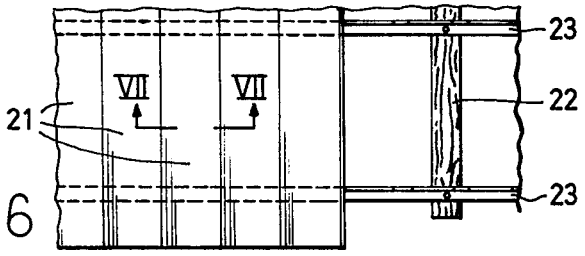
FIG. 6 is a fragmentary top view of a building, the roof of which is being covered with a third form of cladding embodying the invention.
Figure 7:
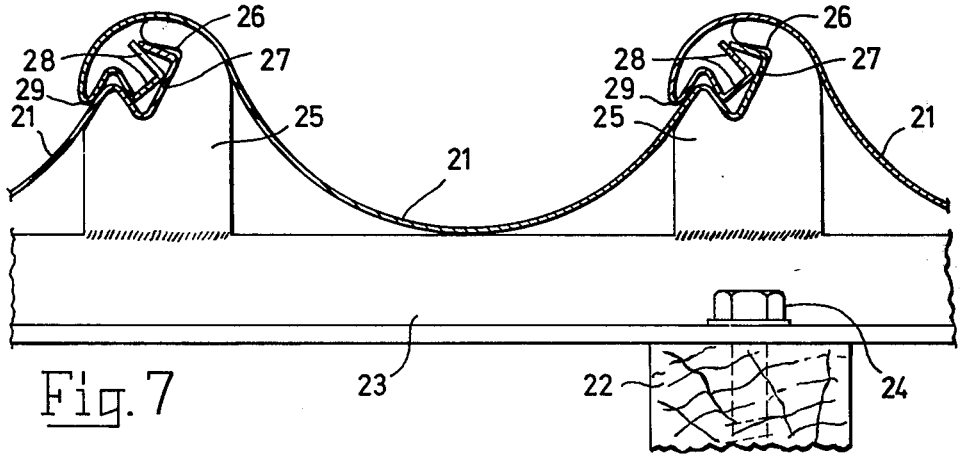
FIG. 7 is an enlarged section taken along the line VII—VII in FIG. 6.

The roof cladding illustrated in FIGS. 6 and 7 differs from the previously described variants mainly by the fact that each panel 21 forms a wave-trough and a wave-crest in a strongly corrugated cladding supported by the rafters 22 of a building, to which the supporting rails 23 for the panels may be directly secured by screws 24, as shown. Also in this case the fastener means 25 are formed from separate plates or ears secured as by welding to the related supporting rail, each fastener means having a substantially dovetail-like incut 26 therein for receiving a snapped in, first longitudinal marginal portion 27 of a related panel. The opposite longitudinal marginal portion of the next adjacent panel comprises an attachment portion 28 that is inserted and clamped in the groove formed by the first marginal portion 27 of the neighboring panel, and a nose portion 29 covering the joint, which is otherwise very similar to that described in connection with FIG. 3 both in appearance and operation of parts.

Of course, many other modifications as to the shape of the panels included in a cladding embodying the invention are feasible and, as should be readily understood already from the given examples, a change of the cross section of the panels may require certain minor modifications of the shape of the fastener means of the supporting rails, although this is certainly not always the case. As has already been mentioned, the panels may be given a larger width then has been shown herein and be longitudinally grooved to thereby simulate two or more "boards" or "waves." Furthermore it is not necessary, of course, to make the incuts in the fastener means and the cross section of the panel marginal to be snapped fast therein almost congruent as described hereinbefore, because it will well suffice if they are capable of co-operating in the manner described.

I claim:

1. A cladding for an exterior wall or a roof of a building and having a weather-exposed external side and an internal side, said cladding comprising, in combination:

(A) a plurality of elongate panels, of which adjacent ones overlap in the direction of their widths, each of said panels having (a) a front face that is partly exposed on the external side of the cladding and a rear face that forms part of the internal side of the cladding, (b) a first longitudinal marginal portion forming a longitudinally extending thin-walled channel of resiliently deformable cross section, said channel opening towards the front face of the panel and having side wall members converging towards the channel opening, and (c) a second and opposite longitudinal marginal portion forming a longitudinally extending ridge-like attachment member on the rear face of the panel, said attachment member being received and retained in said channel of a next adjacent panel in a hook-in-hook-like manner, and (B) a plurality of supporting rails extending in spaced relationship over the wall or roof to be covered in a direction intersecting the longitudinal directions of said panels, (a) each of said rails having, at intervals corresponding to the exposed widths of said panels, fastener means thereon for the attachment of said panels, (b) each of said fastener means comprising an incut with a constricted opening formed in a longitudinally extending, flange-like and rigid projection on the rail, and (c) each such incut having a size and shape to permit said channel formed by said first longitudinal marginal portion of a related one of said panels to enter the incut while having its cross sectional configuration resiliently deformed and to almost recover its original cross sectional configuration when entered, (C) said panels having their channels snapped into the incuts of at least two rails each so as to be firmly retained.

2. A cladding according to claim 1 wherein said incut of each fastener means of the supporting rails has a dovetail-like configuration and a bottom line extending approximately at an angle of between about 40° and about 60° to the longitudinal direction of the rail.

3. A cladding according to claim 1 wherein said channel formed by said first longitudinal marginal portion of each panel has a substantially dovetail-like cross section defined by an inner side wall member extending at a substantially right angle to the main plane of the panel, an outer side wall member extending inwardly towards the longitudinal center line of the panel at an acute angle to the main plane thereof, and a bottom wall member connecting said side wall members and extending at an obtuse angle to the main plane of the panel.

4. A cladding according to claim 1 wherein said ridge-like attachment member formed by said second marginal portion of each panel also has a resiliently deformable cross section, the configuration of which is selected in such a manner that said attachment member is retained in said channel formed by said first longitudinal marginal portion of the next adjacent panel in a clamped position, in which at least one of the two interengaging marginal panel portions is slightly deformed and thus under tension, when the panels are properly mounted on the supporting rails.

5. A cladding according to claim 4 wherein said attachment member formed by said second longitudinal marginal portion of each panel has a cross section approximately resembling an incomplete substantially right-angled triangle defined by a first wall member extending approximately at a right angle to the main plane of the panel, a second wall member forming an acute angle to said first wall member, and a third wall member forming approximately a right angle to said second wall member and having a free edge.

* * * * *